US006283874B1

(12) United States Patent
Studebaker

(10) Patent No.: US 6,283,874 B1
(45) Date of Patent: Sep. 4, 2001

(54) GOLF PUTTER

(76) Inventor: James Studebaker, 177 Regal Ct., Monroeville, PA (US) 15146

( * ) Notice: Subject to any disclaimer, the term of this patent is extended or adjusted under 35 U.S.C. 154(b) by 0 days.

(21) Appl. No.: 09/296,465

(22) Filed: Apr. 22, 1999

(51) Int. Cl.[7] ..... A63B 69/36; A63B 53/16

(52) U.S. Cl. ..... 473/227; 473/295; 473/296; 473/276; 473/239

(58) Field of Search ..... 473/293, 294, 473/295, 296, 276, 212, 244, 206, 552, 227, 239, 229

(56) References Cited

U.S. PATENT DOCUMENTS 1,697,846 * 1/1929 Anderson .
1,967,355 * 7/1934 Edwards .
2,002,108 * 5/1935 Child .
2,949,304 * 8/1960 Williams .
3,524,646 * 8/1970 Wheeler .
3,663,019 * 5/1972 Palotsee .
3,874,668 4/1975 Flege .
4,252,317 2/1981 Vezina .
4,595,204 * 6/1986 Patterson .
4,964,639 * 10/1990 Tucker .
5,127,650 * 7/1992 Schneller .
5,156,401 * 10/1992 Hodgkiss .
5,465,971 * 11/1995 Tischler .
5,520,392 * 5/1996 Foresi .
5,540,159 * 7/1996 Anderson .
5,544,879 * 8/1996 Collins .
5,649,870 * 7/1997 Harrison .
5,997,408 * 12/1999 Bankhead .

* cited by examiner

*Primary Examiner*—Sebastiano Passaniti
(74) *Attorney, Agent, or Firm*—Nixon Peabody LLP; Donald R. Studebaker

(57) ABSTRACT

A putter for use in the game of golf including a first elongated shaft having a first and a second end, a second elongated shaft having a first end telescopically received within the second end of the first elongated shaft, a putter head fixedly secured to a second end of the second elongated shaft and a securing mechanism for fixing an axial and rotational position of the second elongated shaft with respect to the first elongated shaft. Additionally, the first end of the first elongated includes a mechanism for stabilizing the first elongated shaft with respect to the body of the user. Particularly, the stabilizer is received under an arm of the user and is capable of supporting the weight of the user should the user require assistance in walking or utilizing the putter. The putter may include a first elongated shaft in the form of a conventional putter which is received within a second shaft in the form of an upper portion of a quad cane. Accordingly, the present invention may be readily adaptable to any manufacturer's putter to suit the user. Additionally, the upper portion of the quad cane includes a set screw which is threadingly received in the elongated shaft and frictionally engages the shaft of the putter in order to secure both the axial as the rotational positioning of the shaft.

4 Claims, 4 Drawing Sheets

GOLF PUTTER

BACKGROUND OF THE INVENTION

1. Field of the Invention

This invention relates generally to golf clubs and more particularly to a golf putter adapted for one hand putting of a golf ball for elderly or handicapped golfers.

2. Description of the Prior Art

The sport of golf has experienced ever increasing popularity due to the fact that persons of virtually any age, regardless of their athletic prowess or physical handicaps, may participate in the game. In the play of the game of golf it has been determined that the putter club is the single most important club used in the play of the game. Putters come in many different types of designs with it being found that the most accurate type of putter is that of the croquet type or pendulum type with the putting being accomplished by the pendulum type movement of the club between an individual's legs with the individual facing the direction in which the ball is to be putted. However, this style of putting between an individual's legs was ruled illegal by golf societies with it being required that a golfer putt with both feet on the same side of the ball.

In addition, while special clubs have been designed for use by elderly or handicapped persons in need of assistance, such clubs are difficult for the person to use during putting in order to obtain any accuracy such that the elderly or handicapped person is provided with still a greater handicap due to lack of appropriately designed putting clubs permitting efficient putting by such handicapped persons.

In an effort to overcome the aforementioned shortcomings, a pendulum type golf putter was conceived of and disclosed in U.S. Pat. No. 3,874,668 issued to Flege. This device; however, has limitations in that the use of the pendulum type putter requires a pivotal movement of the user at the shoulder with the positioning of the hand with respect to the direction of ball movement being critical. Additionally, the contacting face of the pendulum putter disclosed in the '668 patent is of a limited dimension which may readily result in an off line putt. The pendulum putter of the '668 patent includes a fixed grip portion directed substantially in alignment with the putter face as well as a semi-circular band which rest against the arm of the user. Clearly, it is of absolute necessity that the user be able to align their hand in the exact direction of the line of the putt in order to ensure that the face of the putter contacts the ball perfectly. Should the user be unable to maintain their hand and wrist in such position, the path of travel of the ball will be inaccurate. This is exaggerated by the fact that the putter head is in the form of an elongated rectangular mallet. Likewise, should the user be unable to create a pendulum motion with their shoulder, it will be virtually impossible for the user to accomplish the appropriate putting stroke.

Clearly, there is a need for a golf putter which can be readily used by elderly and handicapped individuals not only for the purposes of putting accurately, but also for support prior to, during and after the putting stroke.

SUMMARY OF THE INVENTION

A primary object of the present invention is to overcome the aforementioned shortcomings associated with the prior art devices.

A further object of the present invention is to provide a putter which essentially includes any known professional type putter head in conjunction with a support device for aiding either elderly or handicapped individuals in playing the game of golf.

A still further object of the present invention is to provide a putter wherein the top portion of the putter includes a cane type structure so as to allow the club to be used for support as needed by elderly and handicapped golfers.

Yet another object of the present invention is to provide a design which allows the golfer to take advantage of pendulum type putting in either a forward or backward stroke.

A still further object of the present invention is to provide a putter design wherein the upper most point of the pendulum type putting stroke is readily fix to aid in creating a smooth pendulum stroke.

Yet another object of the present invention is to provide a putter design wherein the angle of the club face with respect the user's hand position may be readily adjusted in order to accommodate the dexterity of the user.

A still further object of the present invention is to provide a putter design wherein the length of the putter may be readily adjusted so as to accommodate individuals of varying heights and putting stances regardless of there age or handicapped condition.

The present invention recognizes the deficiencies and disadvantages of presently available conventional type golf putters, as well as recognizing the disadvantage of one armed handicapped golf players, and provides a novel solution to both problems in the form of a pendulum type golf putter adapted for putting a golf ball with the use of only a single hand and which is adapted for use with the individual putting from the side of the ball as called for by conventional golfing rules.

It is a feature of the present invention to provide a pendulum golf putter providing for the accurate and efficient one hand putting of a golf ball.

A further feature of the present invention provides a pendulum golf putter adapted for use by handicapped persons having use of only a single hand and which provides for the accurate putting by such handicapped persons.

Among the further features and advantages of the present invention is the provision of a pendulum type golf putter which is relatively simple in its construction and which therefore may be readily manufactured at a relatively low cost and by simple manufacturing methods; one which may readily accommodate golfers of various sizes and statutes; one which is rugged and durable and which therefore may be guaranteed by the manufacturer to withstand many years of intended usage; one which is aesthetically pleasing and refined in appearance; one which is easy to use and reliable and efficient in operation; and one which is otherwise well adapted to perform the services required of it.

These as well as additional object of the present invention are achieved by providing a putter for use in the game of golf comprising a first elongated shaft having a first and a second end, a second elongated shaft having a first end telescopically received within the second end of the first elongated shaft, a putter head fixedly secured to a second end of the second elongated shaft and a securing mechanism for fixing an axial and rotational position of the second elongated shaft with respect to the first elongated shaft. Additionally, the first end of the first elongated includes a mechanism for stabilizing the first elongated shaft with respect to the body of the user. Particularly, the stabilizer is received under an arm of the user and is capable of supporting the weight of the user should the user require assistance in walking or utilizing the putter. Particularly, the putter for use in the game of golf in accordance with the present invention includes a first elongated shaft in the form of a conventional putter which is received within a second shaft in the form of an upper portion of a quad cane. Accordingly, the present invention may be readily adaptable to any manufacturer's putter to suit the user. Additionally, the upper portion of the quad cane includes a set screw which is threadingly received in the elongated shaft and frictionally engages the shaft of the putter in order to secure both the axial as the rotational positioning of the shaft.

These as well as additional objects of the present invention will become apparent upon the following detailed description when read in light of the several figures.

DETAILED DESCRIPTION OF THE PRESENT INVENTION

Figure 2:
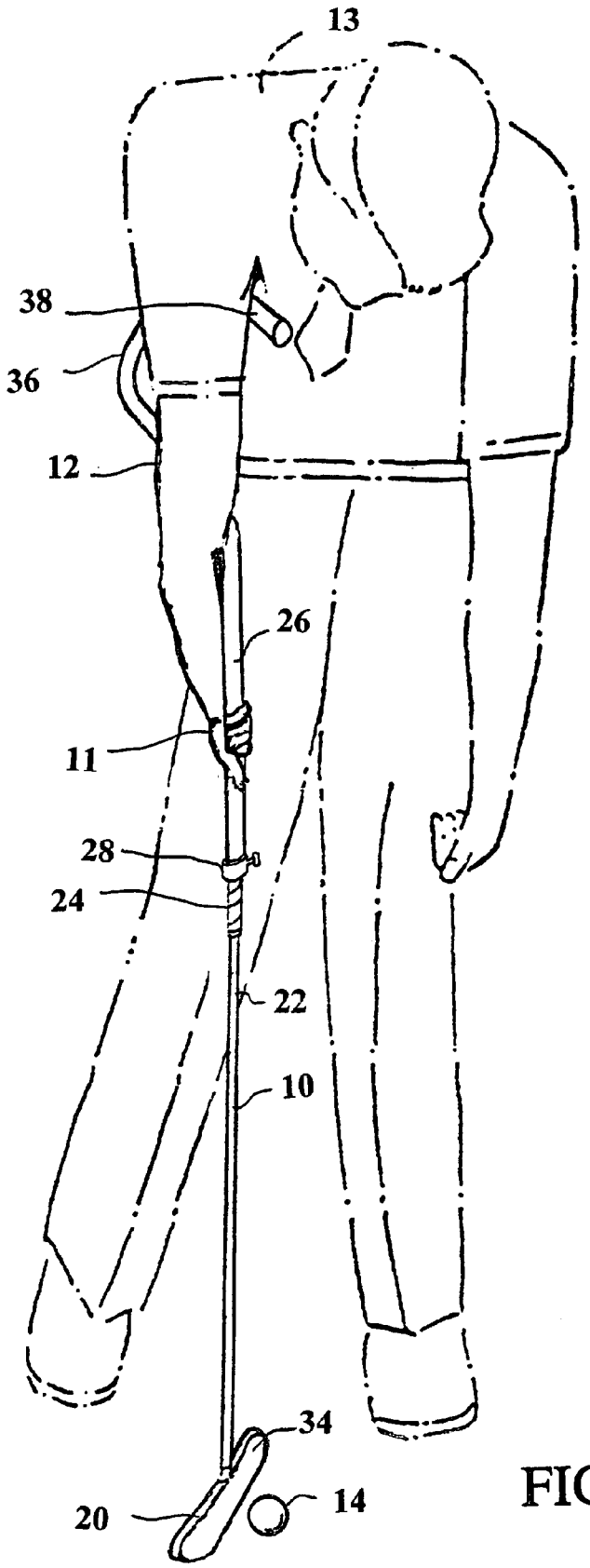
FIG. 2 is a front elevational view of an individual using the golf putter in accordance with the present invention.

Referring now to the several figures in detail, there is illustrated a preferred form of a golf putter constructed in accordance with the present invention and designated generally in its entirety by reference numeral 10 and which as can be seen by FIG. 2 is adaptable for accurate putting using one hand 11 of the associated arm 12 of an individual 13 who is standing on one side of a golf ball 14 in position to putt the golf ball from the side as called for by conventional rules.

Figure 1:
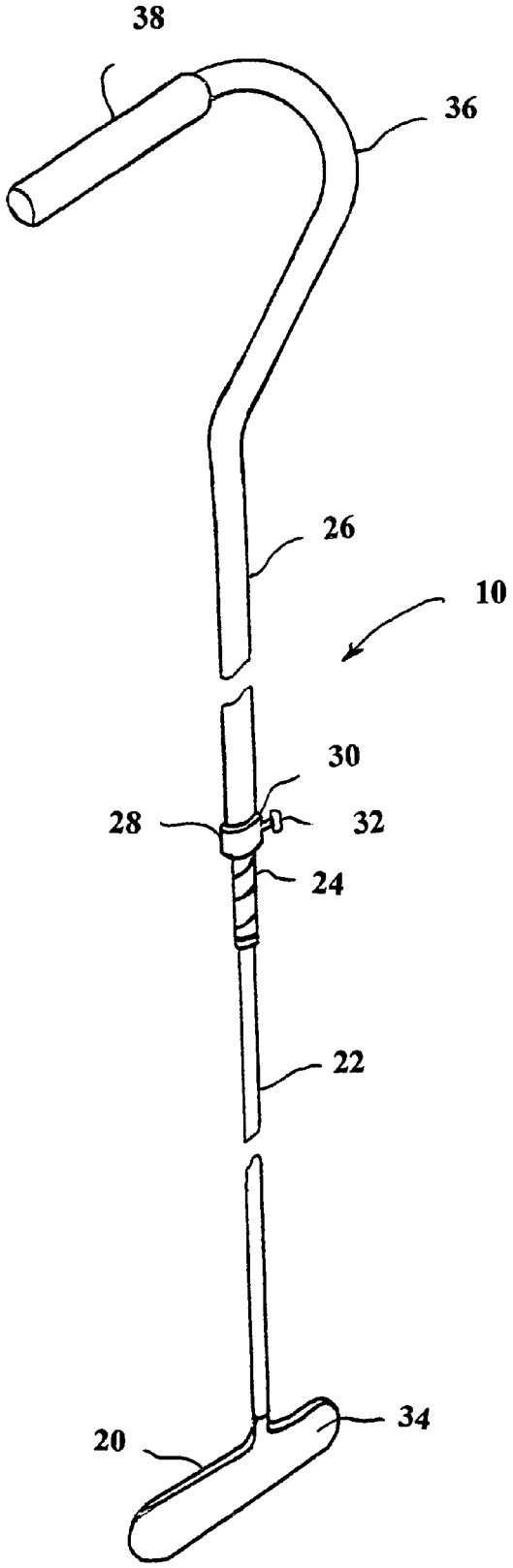
FIG. 1 is a perspective view of a putter in accordance with the present invention.

Reference now to FIG. 1, the putter an for use in the game of golf will now be described in greater detail. The putter 10 includes a putter head 20 fixedly secured to an elongated shaft 22 which may include a grip 24. The portion of the putter in accordance with the present invention may be any conventional putter manufactured by numerous manufacturers throughout the United States and abroad. One unique feature of the present invention is that it allows the user who has become comfortable with a particular putter style to continue to use the preferred putter style in accordance with the present even though additional add is necessary in order to operate the putter.

The upper end of the elongated shaft 22, which as been noted hereinabove may include the grip portion 24, is telescopically received within a second elongated shaft 26 which includes a securing mechanism 28 for securing the putter portion within the second elongated shaft 26. This securing mechanism may take the form of a reinforced collar 30 and set screw 32 which frictionally engages the lower putter portion so as to fix both an axial as well as a rotational position of the elongated shaft 22 with respect to the elongated shaft 26. More particularly, this adjustment feature allows the angular position of the contact surface 34 of the putter head 20 to be adjusted with respect to a stabilizing structure 36.

The stabilizing structure 36 takes the form of bends in the elongated shaft 26 which provides for suitable stabilization of the upper portion of the elongated shaft 26 with respect to the user's body. It can be noted that the end of the stabilizing portion 36 includes a padded region 38 which is received under the arm of the user as can be appreciated by FIG. 2. It is further noted that the elongated shaft 26 in its entirety takes the form of the upper portion of a conventional quad cane which is often utilized by handicapped individuals.

With reference now to FIG. 2, it can be seen that the padded portion 38 of the stabilizing portion 36 is received under the arm of the user in order to stabilize the upper portion of the putter with respect to the user's body. This allows the user to grasp either the elongated shaft 26 as illustrated in FIG. 2, the grip portion 24 or elongated shaft 22 depending upon the stature of the individual in order to create a pendulum motion for directing the ball 14 along an accurate path. As can be appreciated by FIG. 2, a user can thus putt the ball 14 along an accurate path using only one arm. Further, the user may putt the ball either forehand as illustrated in FIG. 2 or backhand depending on which motion is more comfortable for the user. Additionally, as can be appreciated from FIG. 2 by utilizing the securing mechanism 28 the axial positioning of the grip 24 and elongated shaft 22 with respect to the elongated shaft 26 may be readily adjusted. This allows for the putter in accordance with the present invention to be readily adapted to the particular stature and putting stance of the individual utilizing the putter. The curved portion of the putter may also face forward or backward depending on the preference of the user.

Additionally, the securing mechanism 28 allows for the contact surface 34 of the putter head 20 to be rotationally adjusted with respect to the stabilizing portion 36 so as to readily accommodate the positioning of the putter against the user. The orientation and stance of the individual user with respect to the intended line of travel of the ball will dictate the rotational positioning of the elongated shaft 22 within the elongated shaft 26.

Figure 3:
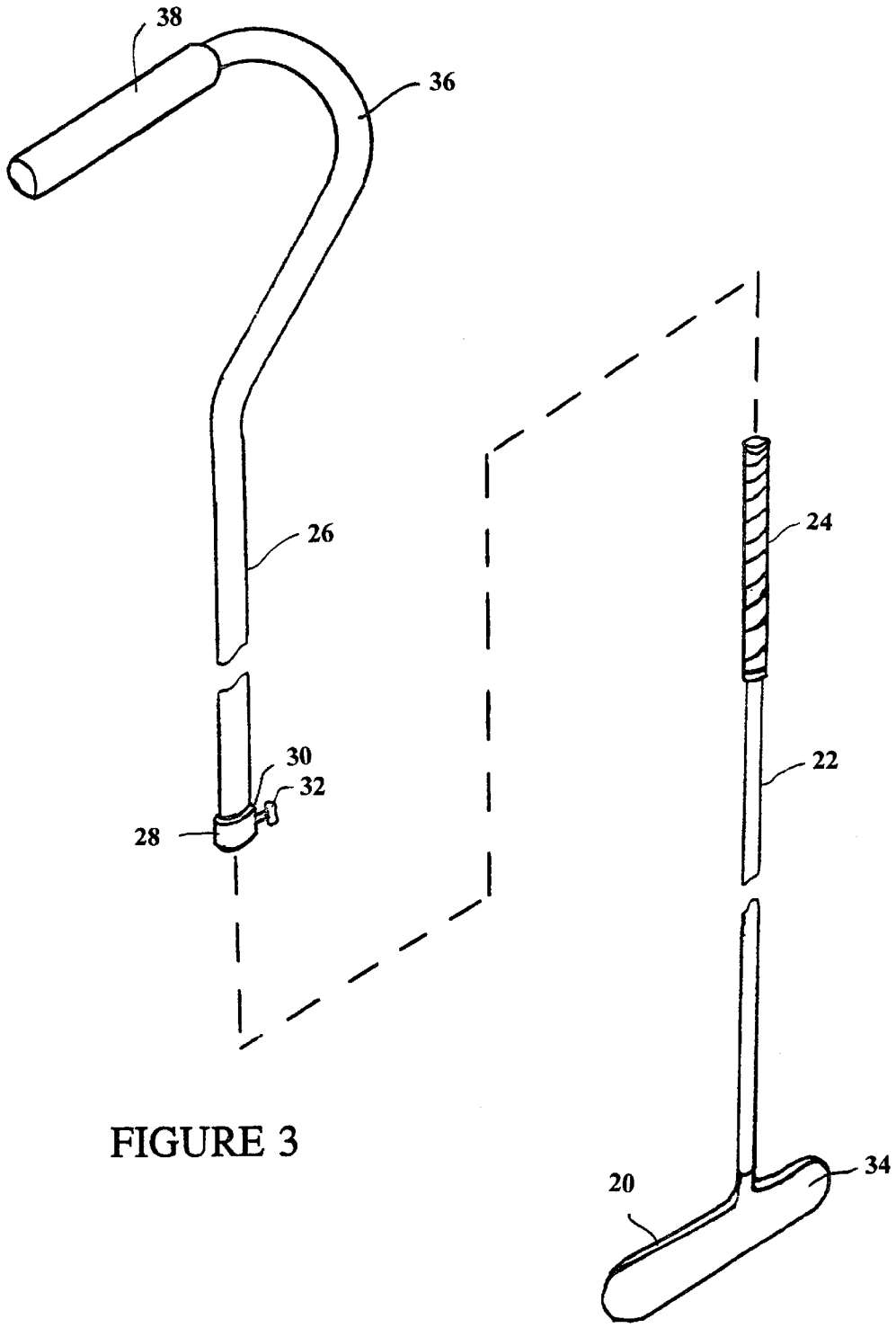
FIG. 3 is an assembly drawing illustrating the manner in which the putter in accordance with the present invention is assembled.

With reference to FIG. 3, it can be seen that the grip portion 24 of the elongated shaft 22 of the putter portion of the putter in accordance with the present invention is readily received within the elongated shaft 26 of the quad cane portion of the putter. Once positioned within the elongated shaft 26 the set screw is tightened against the grip portion 24 or elongated shaft 22 in order to secure the putter portion of the putter within the elongated shaft 26 and to orient the contact face 34 with respect to the stabilizing portion 36 as desired.

Figure 4:
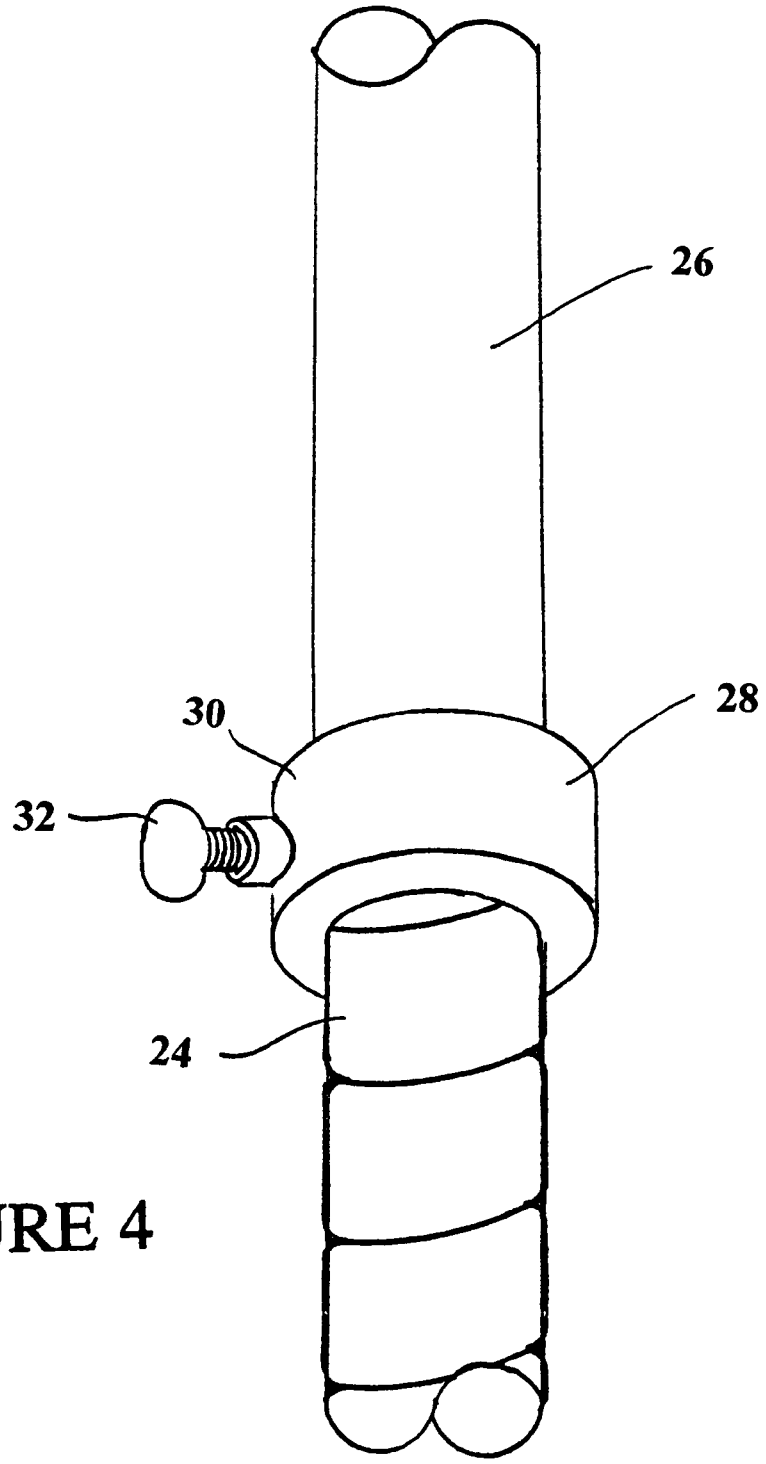
FIG. 4 is an expanded view of the connection between the shafts of the present invention when assembled.

With reference to FIG. 4, the securing mechanism 28 is illustrated in detail an includes set screw 32 which is threadingly received within the collar 30 so as to engage the grip portion 24 of the putter portion of the putter and frictionally retain the grip portion 24 within the elongated shaft 26. Again, the positioning of the putter portion an particularly the grip portion 24 with respect to the elongated shaft 26 may be readily changed by loosening the set screw 32 moving the grip portion 24 to the desired position and again re-tightening the set screw. Such an adjustment may be readily achieved during play by the user.

In addition to creating a stabilized pendulum motion for putting the ball 14 along the intended path, the top portion or quad cane portion of the putter allows the club to be used for support as needed by older golfers, golfers with handicaps or golfers who are temporarily injured. The putter when not used for putting may be readily utilized as a crutch for aiding and supporting the weight of the user either when walking, standing observing the game or when addressing a putt.

Accordingly, the putter assembly 10 set forth in accordance with the present invention provides a distinct advantage for those older golfers or golfers with injuries or handicaps which prevent the use of a conventional putter. Particularly, the putter assembly in accordance with present invention not only provides for a stabilized pendulum motion when putting, also provides a support structure for assisting the user in playing the game of golf. Again, the present invention employs a putter for use in the game of golf which includes a first elongated shaft in the form of a quad cane and a second elongated shaft in the form of a conventional putter which is telescopically received within the first elongated shaft and a securing mechanism for fixing both the axial and rotational positioning of the putter portion within the quad cane. Again, the quad cane portion utilized or stabilizing an upper portion of the putter assembly with respect to the user's body and particularly by positioning the upper portion of the putter assembly under the arm of the user providing for a stable top point of the pendulum. Again, the putter portion of the putter assembly is readily adjustable with respect to the stabilizing or quad cane portion of the putter assembly. Particularly, the angular orientation of the contact face of the putter portion of the putter assembly may be readily adjusted with respect to the stabilizing portion of the putter assembly. Additionally, the axial length of the putter may be readily adjusted to accommodate the stature and stance of the user.

While the present invention has been described with reference to the preferred embodiment, it will be appreciated by those skilled in the art that the invention may be practiced otherwise then as specifically described herein without departing from the spirit and scope of the invention. It is, therefore, to be understood that the spirit and scope of the invention be limited only by the appended claims.

What is claimed is:

1. A putter and support for use by a golfer requiring assistance comprising:

a first elongated shaft having a first end and a second end;

a stabilizer fixedly secured substantially transverse to the first end of said first elongated shaft and configured to be received under an arm of the golfer for supporting the golfer and maintaining the first end of said first elongated shaft in a fixed position relative to the golfer when putting;

a second elongated shaft extending substantially collinearly with respect to said first elongated shaft and having a first end telescopically received within the second end of the said first elongated shaft;

a putter head fixedly secured to a second end of said second elongated shaft; and a securing means constructed and arranged to secure said first elongated shaft to said second elongated shaft in any selected axial and rotational position with respect to each other, whereby both the length of the putter and the angular orientation of the stabilizer with respect to the putter head may be varied.

2. A putter as defined in claim 1, wherein said securing means includes a set screw threadingly received in said first elongated shaft for frictionally engaging said first end of said second elongated shaft.

3. A putter is defined in claim 1, wherein said second elongated shaft is a shaft for a putter.

4. The putter as defined in claim 1, wherein said first elongated shaft is an upper portion of a quad cane.

* * * * *